United States Patent [19]

Dean

[11] Patent Number: 4,662,549

[45] Date of Patent: May 5, 1987

[54] CHILD'S BACKPACK

[76] Inventor: Pat M. Dean, 103 Springfield Pl., Goose Creek, S.C. 29445

[21] Appl. No.: 760,149

[22] Filed: Jul. 29, 1985

[51] Int. Cl.[4] ..... A45F 4/02

[52] U.S. Cl. ..... 224/153; 224/209; 446/28

[58] Field of Search ..... 224/202, 153, 209, 210, 224/211, 212, 213, 259; D3/31; D21/82; 446/26, 28

[56] References Cited

U.S. PATENT DOCUMENTS

| | | | |
|---|---|---|---|
| 432,607 | 7/1890 | Dwyer | 224/153 |
| 447,669 | 3/1891 | Dwyer | 224/153 |
| 2,428,795 | 10/1947 | Frazee | 224/153 |
| 3,622,056 | 11/1971 | Droeger | 224/153 |
| 3,802,613 | 4/1974 | Droeger | 224/153 |
| 3,902,640 | 9/1975 | Geiben | 224/153 |
| 4,085,873 | 4/1978 | Schweitzer | 224/153 |
| 4,236,615 | 12/1980 | Ginat | 224/202 |
| 4,236,657 | 12/1980 | Brunton | 224/153 |
| 4,420,103 | 12/1983 | Douglass | 224/153 |
| 4,423,834 | 1/1984 | Rush | 224/153 |

OTHER PUBLICATIONS

EMS Sac Du Jour, Eastern Mountain Sports, Fall/Winter Catalogue 1983, pp. 54, 48.

*Primary Examiner*—Stephen Marcus
*Assistant Examiner*—David Voorhees
*Attorney, Agent, or Firm*—Terry B. McDaniel

[57] ABSTRACT

A child's backpack is disclosed which is adapted to function both as an article for carrying items such as books and as an article for amusement. The invention backpack is constructed such that an extension from the rear face above the body of the backpack is provided which acts as a cover flap for the opening of the backpack. This flap is constructed in such a manner that it forms a pocket with an opening along the end edge of the flap. An article of amusement is stored within the pocket, and, upon opening the pocket and ejecting the article, the backpack is converted to an object of play.

13 Claims, 4 Drawing Figures

CHILD'S BACKPACK

BACKGROUND OF THE INVENTION

1. Field of the Invention

This invention relates to a backpack to be carried primarily on the back of a juvenile wearer and adapted to function to carry articles such as books, clothing, foodstuffs, etc. or for use in conjunction with child's play by incorporating in the cover flap of the backpack an ejectable amusement article suitable for attachment to one's back, such as a parachute or the cape of a superhero personality. The cover flap of the backpack is constructed to provide an opening in the end edge of the flap which opening may contain the amusement article.

2. Description of the Prior Art

Conventional backpacks designed for juvenile wearers for carrying school books, clothing, and/or lunches normally are not convertible to an amusement article. Also, the quality of manufacture and design of the backpack results in a short product lifespan when subjected to everyday use. One conventional design feature of such backpacks is the manner of attachment of the back supporting shoulder straps to the backpack article. Normally, the ends of the shoulder straps are incorporated, usually by sewing, into the seams of the backpack article where the rear face joins either top, bottom, or side pieces. The result of pressure on the shoulder straps produced by the weight of items contained within the backpack invariably causes the shoulder straps to tear or the seam in which they are enjoined to come apart.

Therefore, an object of the present invention is to provide a functional backpack which is convertible to an article of amusement. A further object of this invention is to provide a child's backpack for carrying school books which also may be used as an article of play by providing an ejectable toy to be stored in an opening in the cover flap of the backpack. An additional object of this invention is to provide a backpack of improved durability by the method of attachment of the shoulder straps to the backpack.

SUMMARY OF THE INVENTION

The above stated objects are met in the present invention which includes a child's backpack adapted to function both as an article for carrying items such as books and as an article for amusement. An improved construction of the backpack resides in the manner of attachment of the shoulder straps wherein the straps are attached continuously along the vertical length of the rear face of the backpack contacting the wearer's back. The invention backpack also is constructed such that an extension from the rear face above the body of the backpack is provided which acts as a cover flap for the opening of the backpack. This flap is constructed in such a manner that it forms a pocket with an opening along the end edge of the flap. By storing within this flap-pocket an article of amusement which may be ejected from but remain attached to the flap, an object of the invention is achieved. In particular, it is envisioned that such an article may be in the form of a miniature, non-functioning parachute or a cape which may be identified with a "superhero" personality.

BRIEF DESCRIPTION OF THE DRAWINGS

The preferred form of the invention is illustrated in the accompanying drawings forming a part of this specification, in which:

FIG. 3 depicts the toy parachute suspended above a wearer after jumping from a low height.

While only the preferred form of the invention is shown, it should be understood that various changes or modifications may be made within the scope of the claims attached hereto without departing from the spirit of the invention.

DETAILED DESCRIPTION OF THE PREFERRED EMBODIMENTS

Figure 1:
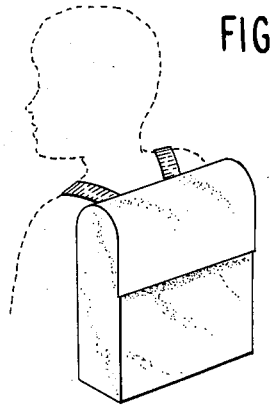
FIG. 1 is a perspective view of a child's backpack constructed in accordance with the present invention, the parts of the backpack being shown in operative position for carrying articles within the backpack on the back of a wearer.

Referring to the drawings in greater detail, the child's backpack of the present invention basically includes an enclosed receptacle of flexible material which may conveniently consist of natural or synthetic fabric, leather, plastic, or other suitable flexible sheet material, having substantially flat and substantially parallel front and rear faces. The three dimensional nature of the receptacle is provided by the separation of the front and rear faces by narrower side and bottom faces, which also creates an opening at the top of the receptacle structure. An extension from the top of the rear face is provided which forms a cover for the opening to the receptacle by overlapping a portion of the top of the opposing front face. The backpack is provided further with a pair of shoulder straps attached to the rear face of the receptacle for attachment to a wearer's back. FIG. 1 shows a backpack constructed in accordance with the present invention as worn on the back of a wearer in operative position for carrying items within.

Figure 4:
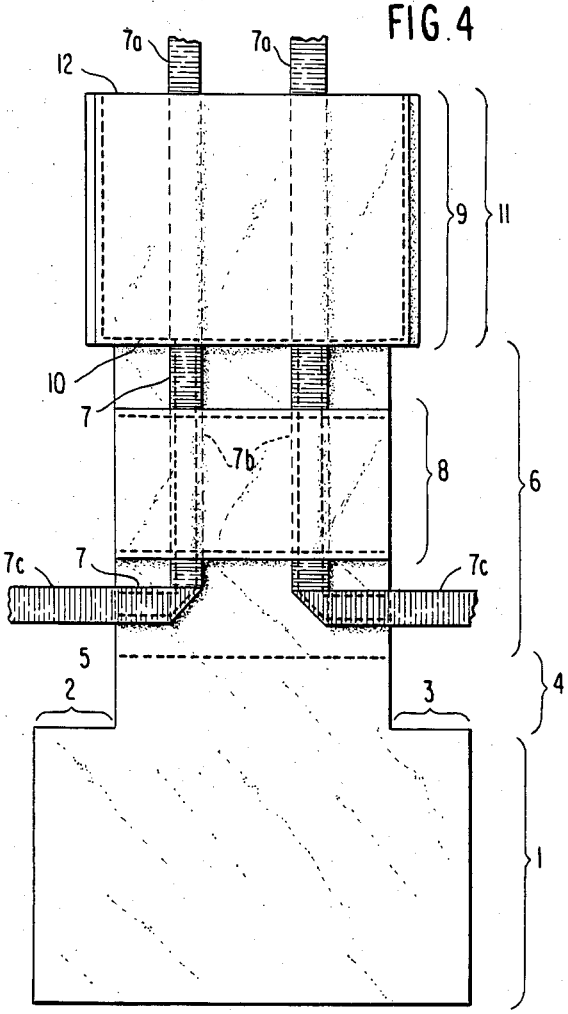
FIG. 4 is a perspective view of a child's backpack constructed in accordance with the present invention, the parts of the backpack being shown to depict the manner of attachment of the shoulder straps to the rear face of the backpack.

The improvement provided by the present invention lies in the construction of the closure flap of the receptacle whereby a pocket is formed for carrying an article of amusement such as a toy parachute or a cape. In particular, the closure flap pocket is designed to be opened easily by the wearer to permit ejection of the article for play. Such a construction is provided in the backpack made in the manner depicted in FIG. 4. Referring to FIG. 4, the various parts of the most preferred embodiment of the invention backpack are shown in mid-construction. The backpack is comprised of an enclosed receptacle and shoulder straps for attachment of the receptacle to a wearer's back. A single seamless piece of flexible material is shown to form the front face 1, side faces 2 and 3, and bottom face 4 of the receptacle. Of course, the front face and side faces could be formed from separate pieces of flexible material and joined together to form the structure shown in FIG. 4 as one piece. However, use of a single, seamless piece of material results in a more durable backpack by elimination of unnecessary seams.

At seam 5, bottom face 4 is connected to rear face 6 along its bottom edge. Shoulder straps 7 are situated onto front face 6 as shown. The shoulder straps are continuous strips of material comprised of upper end sections *7a*, middle sections *7b*, and lower end sections *7c*. The upper and lower ends of the shoulder straps represent the terminal portions of the upper and lower end sections, respectively. The middle sections *7b* of the shoulder straps are so situated on the side of the rear face which will be internal to the receptacle upon completion of the construction by folding the front face to a position parallel with the rear face and folding the side faces to positions parallel with each other and perpendicular to the front and rear faces. Overlaying both front face 6 and the middle sections *7b* of shoulder straps 7 is a liner facing 8. The dimensions of this liner facing may range from as large as approximately the same dimensions as the rear face to as small as dimensions which permit coverage of the major portion of the middle sections of the shoulder straps. The middle sections *7b* of the shoulder straps 7 are permanently affixed to both the rear face 6 and the liner facing 8, and liner facing 8 is permanently affixed to rear face 6.

From the top edge of rear face 6 a cover flap is provided for the receptacle in the form of extension 9. If extension 9 is provided as a separate piece of flexible material, it is connected to rear face 6 at seam 10. If extension 9 and rear face 6 are provided as a single piece of flexible material, openings in the form of slits are provided at the top edge of rear face 6 through which the upper sections *7a* of shoulder straps 7 travel; and, although not necessary to connect the rear flap and its extension, a seam (or row of stitches) may be provided to reinforce attachment of the shoulder straps to the rear face.

Figure 2:
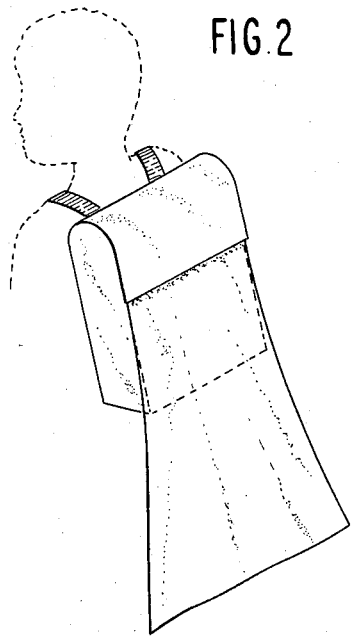
FIGS. 2 and 3 are perspective views of a child's backpack constructed in accordance with the present invention, the parts of the backpack being shown in operative position for use as an article of amusement while on the back of a wearer. In particular.
Figure 3:
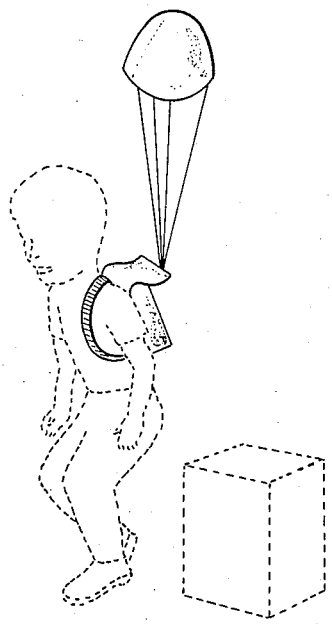

Superimposed over extension 9 is a liner facing 11 of approximately the same dimensions as extension 9. By permanently affixing liner facing 11 to extension 9 by joining their respective borders along the sides and seam 10, a closure flap pocket is formed with an opening 12 along the end edge of the closure flap. The closure flap pocket is designed to store a folded article of amusement such as a toy parachute or a cape which, upon opening the closure flap pocket, will eject from the pocket. One end of the article of amusement should be attached to the inside of the closure flap pocket so the article may be used in play while wearing the backpack (as depicted in FIGS. 2 and 3).

In order to secure the closure flap pocket to the front face to retain items carried within the receptacle, a closure means is provided for temporarily securing liner facing 11 of the closure flap pocket construction to front face 1 of the receptacle. The preferred closure means are metal snaps or velcro.

In order to temporarily secure the closure of the opening along the end edge 12 of the closure flap pocket to retain the article of amusement within the pocket, a closure means is provided to operate between the opposing sides of the opening formed by the extension 9 and the liner facing 11. It is preferred that this closure means be adapted for quick release. The most preferred quick release adaptation is provided by a closure means formed with one or more metal snaps or with reciprocal velcro connectors and a drawstring contained within the closure flap pocket. The terminal end of the drawstring is designed to be attached to the end edge of extension 9 and the initiating end of the drawstring preferably exits the closure flap pocket through a small opening provided in extension 9 near seam 10 (and preferably near either side edge of extension 9). A pull ring of a size larger than the small opening is connected to the initiating end of the drawstring; and, if minimal slack is provided for in the drawstring, the closure means securing the opening along the end edge of the closure flap pocket is quickly released by a sharp pull on the ring. This will permit ejection of the article of amusement contained within the closure flap pocket.

In order to secure the backpack to the back of a wearer, the upper and lower ends of shoulder straps 7 are adapted with means for securely and adjustably connecting each strap's upper end to its lower end. The preferred connecting means is provided by reciprocal velcro tape connectors affixed onto the respective upper and lower ends of the upper and lower end sections of the shoulder straps. The amount of adjustment for wearers of different sizes is provided by variability of overlap of the reciprocal velcro tape connectors. Obviously, other connecting means, such as buckles, snaps, buttons, tabs, or simply tying the respective upper and lower ends together, could be employed.

The preferred flexible sheet material for the invention backpack construction is a lightweight but durable synthetic fabric, such as nylon. Where the flexible sheet material is a natural or synthetic fabric or leather, the envisioned method of permanently affixing the respective elements of the backpack, i.e., face to face or shoulder strap to face, is by sewing. Where plastic is used, such connections may be by heat-sealing.

What is claimed is:

1. An improved backpack comprising (1) an enclosed receptacle of flexible material formed of substantially flat and substantially parallel front and rear faces separated by side and bottom faces lying in planes substantially perpendicular to the front and rear faces leaving an opening at the top of the receptacle for receiving items to be carried within the receptacle and for which opening a closure flap is formed by an extension from the top of the rear face which, upon covering the opening of the receptacle, overlaps a portion of the front face, and (2) a pair of shoulder straps attached to the rear face of the receptacle for attachment to a wearer's back, wherein the improvement comprises a closure flap construction in the form of a pocket with an opening along the end edge of the closure flap pocket and, stored within the closure flap pocket, an article of amusement selected from the group consisting of a miniature, non-functioning parachute and a cape which may be ejected from but remains attached to the closure flap pocket.

2. The improved backpack of claim 1 wherein the flexible material is selected from the group consisting of natural fabrics, synthetic fabrics, leather, and plastic.

3. The improved backpack of claim 1 wherein the pocket is formed by the extension from the top of the rear face and a first liner facing of flexible material having dimensions approximately equal to the extension.

4. The improved backpack of claim 3 wherein the closure flap pocket comprises a first closure means for temporarily securing the closure flap pocket to the front face to retain the items carried within the receptacle, which closure means operates between the front face and the first liner facing of the closure flap pocket.

5. The improved backpack of claim 4 wherein the first closure means is provided by reciprocal velcro connectors respectively affixed on the front face and the first liner facing and positioned to permit interaction between the reciprocal velcro connectors upon overlapping of the portion of the front face by the closure flap pocket.

6. The improved backpack of claim 5 wherein the opening along the end edge of the closure flap pocket comprises a second closure means for securing the article of amusement within the pocket which closure means is adapted for quick release to permit ejection of the article from the pocket.

7. The improved backpack of claim 6 wherein the second closure means is provided by reciprocal velcro connectors affixed on the opposing faces of the opening along the end edge of the closure flap pocket and wherein the adaptation for quick release is provided by a drawstring the terminal end of which is affixed to the side of the opening along the end edge of the closure flap pocket opposite the side of the opening which may be secured to the front face via the first closure means.

8. The improved backpack of claim 1 wherein the shoulder straps are comprised of upper and lower ends adapted with means for securely and adjustably connecting each strap's upper end to its lower end.

9. The improved backpack of claim 8 wherein the adaptation comprises reciprocal velcro tape connectors permanently affixed onto the respective upper and lower shoulder strap ends, the adjustability being provided by variability of overlap of the reciprocal velcro tape connectors.

10. The improved backpack of claim 9 wherein the shoulder straps are securely attached continuously along the approximate verical length of the rear face of the receptacle.

11. The improved backpack of claim 10 wherein the shoulder straps are attached along the rear face internal to the receptacle between the rear face and a second liner facing of flexible material having dimensions approximately the same as the rear face, the upper ends of the straps becoming external of the receptacle at the top of the receptacle through a seam formed by joining the rear face and the closure flap and the lower ends of the straps becoming external of the receptacle through a seam formed by joining the rear face and side faces.

12. The improved backpack of claim 1 wherein the front face, bottom face, and side faces are constructed from a single, seamless piece of flexible material.

13. The improved backpack of claim 1 wherein the rear face and the closure flap are constructed from a single, seamless piece of flexible material.

* * * * *